US005612140A

United States Patent [19]

Sogabe

[11] Patent Number: 5,612,140

[45] Date of Patent: Mar. 18, 1997

[54] THERMAL TRANSFER RECORDING MEDIUM

[75] Inventor: Jun Sogabe, Osaka, Japan

[73] Assignee: Fujicopian Co., Ltd., Osaka, Japan

[21] Appl. No.: 424,306

[22] PCT Filed: Aug. 29, 1994

[86] PCT No.: PCT/JP94/01423

§ 371 Date: Apr. 26, 1995

§ 102(e) Date: Apr. 26, 1995

[87] PCT Pub. No.: WO95/06565

PCT Pub. Date: Mar. 9, 1995

[30] Foreign Application Priority Data

Aug. 30, 1993 [JP] Japan ..... 5-214019

[51] Int. Cl.[6] ..... B41M 5/26

[52] U.S. Cl. ..... 428/484; 428/195; 428/488.1; 428/500; 428/913; 428/914

[58] Field of Search ..... 428/195, 484, 428/488.1, 488.4, 913, 914, 500

[56] References Cited

U.S. PATENT DOCUMENTS 4,983,445 1/1991 Ueyama .

FOREIGN PATENT DOCUMENTS

| | | | |
|---|---|---|---|
| 0381169 | 8/1990 | European Pat. Off. | B41M 5/38 |
| 62-37189 | 2/1987 | Japan | B41M 5/26 |
| 63-89386 | 4/1988 | Japan | B41M 5/26 |
| 2-130192 | 5/1990 | Japan | B41M 5/40 |
| 2-204092 | 8/1990 | Japan | B41M 5/30 |

*Primary Examiner*—Bruce H. Hess
*Attorney, Agent, or Firm*—Fish & Neave

[57] ABSTRACT

A thermal transfer recording medium comprising a foundation and a heat-meltable ink layer provided on the foundation, the ink layer containing 50 to 80% by weight of an ethylene-vinyl acetate copolymer having a vinyl acetate content of not more than 19% by weight, 0 to 20% by weight of a wax having a melting point of 70° to 90° C., 0 to 20% by weight of a resin having a glass transition point of 50° to 140° C., and 20 to 50% by weight of a coloring agent, provided that at least one of the wax having a melting point of 70° to 90° C. and the resin having a glass transition point of 50° to 140° C. is necessarily contained, the vehicle in the ink layer having a softening point of 60° to 85° C., a melt viscosity at 100° C. of not lower than 1,000 poises and a melt viscosity at 160° C. of not higher than 400 poises, in order to make it possible to print clearly on a rough paper sheet with a small amount of energy and prevent the paper sheet from scumming in continuous printing.

6 Claims, 2 Drawing Sheets

THERMAL TRANSFER RECORDING MEDIUM

TECHNICAL FIELD

The present invention relates to a thermal transfer recording medium which is devised to form print images of high quality even on a paper sheet having poor surface smoothness (hereinafter referred to as "rough paper"). Hereinafter this thermal transfer recording medium is referred to as "rough paper-adaptable thermal transfer recording medium".

BACKGROUND ART

A conventional rough paper-adaptable thermal transfer recording medium uses the so-called bridgingly transferable heat-meltable ink layer which is transferred as bridging over depressed portions of a rough paper while adhering to only protruded portions thereof. In order to impart such bridging transferability to an ink layer, a heat-meltable material having a high melt viscosity such as a high melt viscosity resin, for example, ethylene-vinyl acetate copolymer, is used as a main component of the vehicle thereof.

However, such an ink layer having a high melt viscosity is poor in fixing property and, hence, involves drawbacks such as falling-off of print images obtained therefrom due to abrasion or the like. In order to improve the fixing property of such an ink layer, a large amount of energy must be applied during thermal transfer.

A heat-meltable material having a high melt viscosity shows a small viscosity change over the temperature range of temperatures in the vicinity of ordinary temperature to transferring temperature due to the characteristics of the material.

FIG. 1 is a graph schematically showing relationships between temperature and melt viscosity with respect to various heat-meltable materials. Curve B shows a viscosity curve of an ethylene-vinyl acetate copolymer having a high melt viscosity.

As described above, a heat-meltable material having a high melt viscosity shows a small viscosity change and, hence, when it is attempted to lower the viscosity of the material at a temperature for transferring in order to improve fixing property of print images, the material shows a low viscosity even at temperatures in the vicinity of ordinary temperature, as shown in Curve C of FIG. 1.

Accordingly, when an ink layer is adapted to be transferred with a small amount of energy, the ink layer exhibits poor bridging transferability and also has a decreased softening point, resulting in the following drawback. When printing is performed continuously, heat is accumulated in a thermal head to heat the overall head. Since the softening point of the ink layer is low, portions of the ink layer which correspond to non-activated heat generating dots are also softened, resulting in scumming of a receptor paper.

In view of the foregoing, an object of the present invention is to provide a thermal transfer recording medium which exhibits good bridging transferability and fixing property and has a high softening temperature, thereby forming clear print images even on a rough paper with a small amount of energy and causing no scumming of a receptor paper even in continuous printing.

DISCLOSURE OF THE INVENTION

The present invention provides a thermal transfer recording medium comprising a foundation and a heat-meltable ink layer provided on the foundation, the ink layer containing 50 to 80% by weight of an ethylene-vinyl acetate copolymer having a vinyl acetate content of not more than 19% by weight, 0 to 20% by weight of a wax having a melting point of 70° to 90° C., 0 to 20% by weight of a resin having a glass transition point of 50° to 140° C., and 20 to 50% by weight of a coloring agent, provided that at least one of the wax having a melting point of 70° to 90° C. and the resin having a glass transition point of 50° to 140° C. is necessarily contained, the vehicle in the ink layer having a softening point of 60° to 85° C., a melt viscosity at 100° C. of not lower than 1,000 poises and a melt viscosity at 160° C. of not higher than 400 poises.

The first feature of the present invention exists in provision of physical properties of the ink layer.

Figure 1:
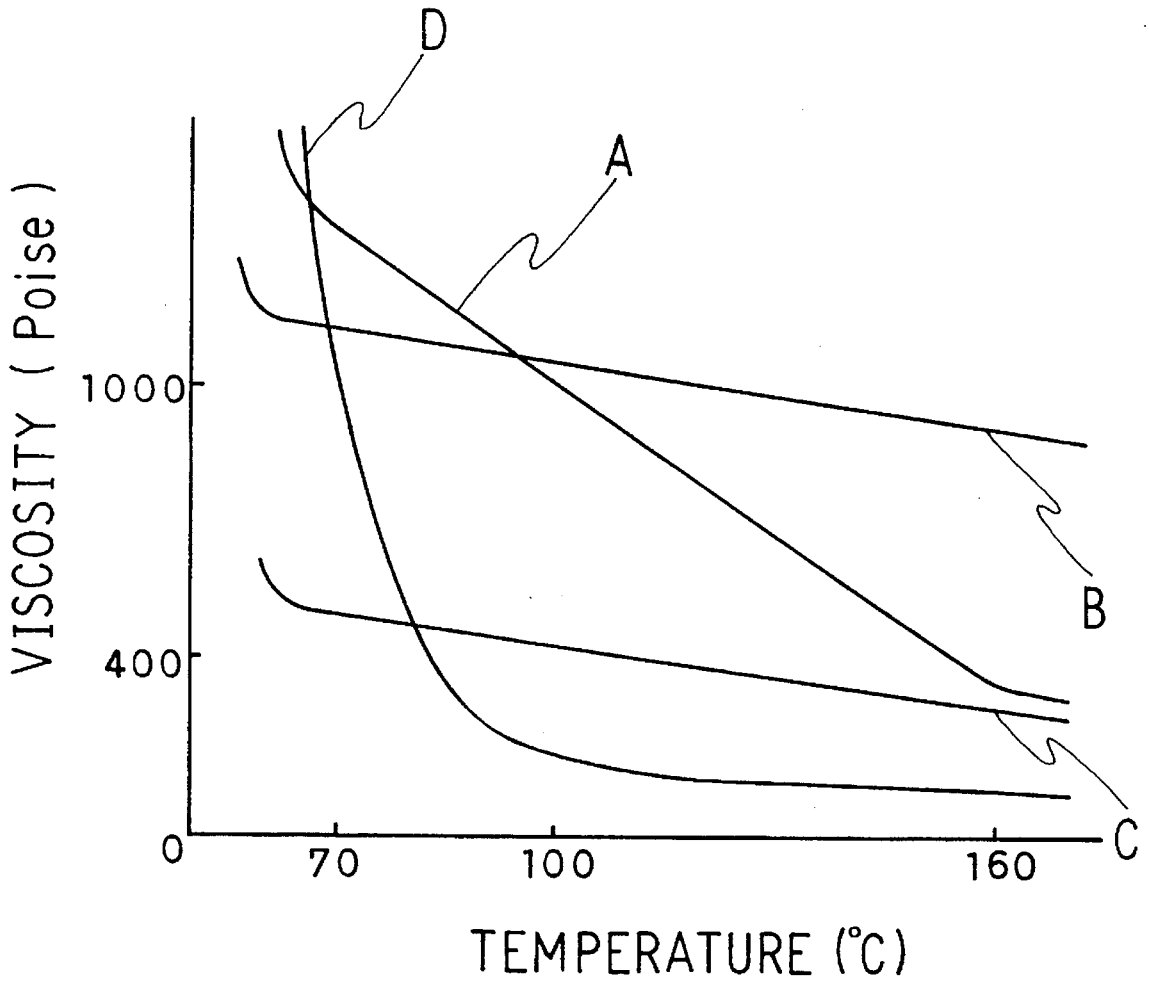
FIG. 1 is a graph showing melt viscosity curves of a heat-meltable ink layer used in the present invention (Curve A), an ethylene-vinyl acetate copolymer having a high melt viscosity ( Curve B), an ethylene-vinyl acetate copolymer having a low melt viscosity (Curve C) and a wax (Curve D).

That is, the vehicle in the ink layer according to the present invention has a softening point of 60° to 85° C., a melt viscosity at 100° C. of not lower than 1,000 poises and a melt viscosity at 160° C. of not higher than 400 poises. In FIG. 1, an example of the melt viscosity curve of an ink layer in accordance with the present invention is shown as Curve A.

The ink layer according to the present invention does not cause scumming of a receptor paper even during continuous printing because the vehicle thereof has as a high softening point as 60° to 85° C. An ink layer having a softening point of lower than 60° C. is prone to cause scumming of the receptor paper during continuous printing. An ink layer having a softening point of higher than 85° C. is poor in transfer sensitivity.

The ink layer according to the present invention exhibits excellent bridging transferability as well as excellent fixing property because the vehicle thereof has a melt vicosity at 100° C. of not lower than 1,000 poises and a melt viscosity at 160° C. of not higher than 400 poises. The reason therefor is as follows.

Figure 2:
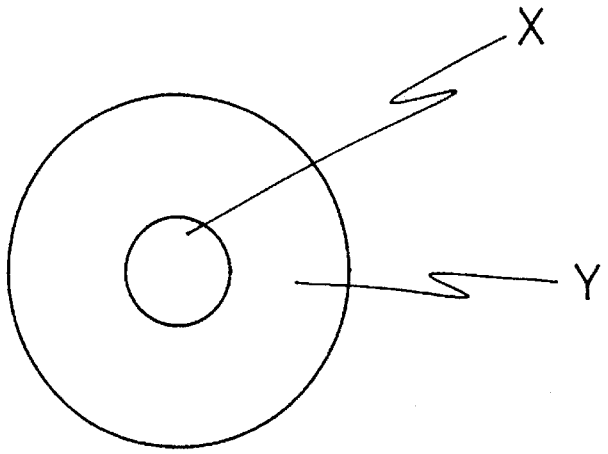
FIG. 2 is an explanatory view showing a temperature distribution of an ink dot.
Figure 3:
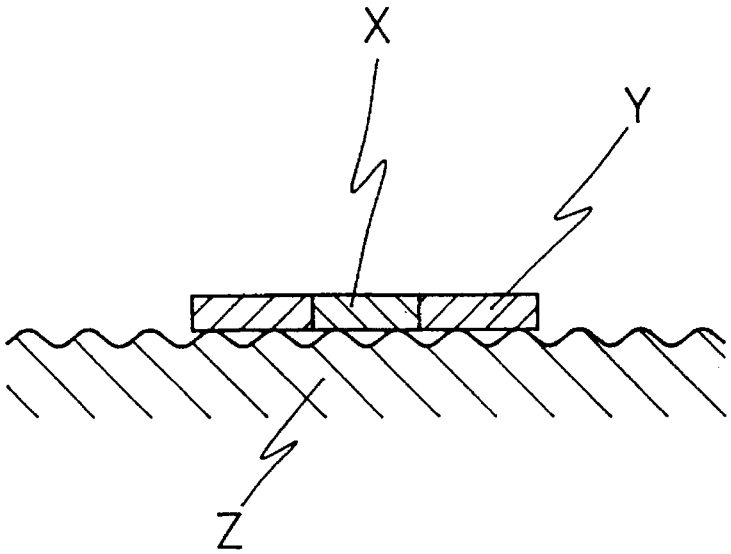
FIG. 3 is an explanatory view showing a state where an ink dot is bridging-transferred on a rough paper.

The present inventor's investigation reveals that when a heat-meltable ink layer is melt-transferred by selectively heating it from the back side of the foundation by means of a thermal head, a portion of the ink layer heated (hereinafter referred to as "ink dot") has such a temperature distribution that the central portion (X) has higher temperatures and the peripheral portion (Y) has lower temperatures, as shown in FIG. 2. In FIG. 2, the outer edge of the peripheral portion (Y) corresponds to the outer edge of a heat-generating element. When transferring with usual printing energy (for example, 15 to 20 mJ/mm$^2$), the ink dot has an average temperature of about 160° C. at the central portion (X) and an average temperature of about 100° C. at the peripheral portion (Y).

As described above, the viscosity of an ink when melting must be high from the viewpoint of improving the bridging transferability thereof, and must be low from the viewpoint of improving the fixing property thereof.

The present inventor's research regarding the aforesaid temperature distribution characteristics of the ink dot when transferring have revealed the following fact: When an ink having a high viscosity (not lower than 1,000 poises) at 100° C. and a low viscosity (not higher than 400 poises) at 160° C. is used, the ink is in a melt having a low viscosity at the central portion (X) where the temperature is about 160° C. so that it is sufficiently penetrated into protruded portions of a rough paper Z, thus realizing an improved fixing property, and, on the other hand, the ink is in a melt having a high viscosity at the peripheral portion (Y) where the temperature is about 100° C. so that the bridging transferability of the ink dot as a whole is not degraded despite the low viscosity of the ink at the central portion (X).

Thus, the use of an ink of which the vehicle has a melt viscosity at 100° C. of not lower than 1,000 poises and a melt viscosity at 160° C. of not higher than 400 poises fulfills the bridging transferability as well as the fixing property.

When the melt viscosity of the vehicle at 100° C. is lower than 1,000 poises, the bridging transferability is degraded, resulting in failure to form clear images on a rough paper. When the melt viscosity of the vehicle at 160° C. is higher than 400 poises, the fixing property is degraded and, hence, a large mount of energy is required for printing. The upper limit of the melt viscosity of the vehicle at 100° C. is about 30,000 poises and the lower limit of the melt viscosity of the vehicle at 160° C. is about 10 poises.

The second feature of the present invention exists in provision of the ink formula.

That is, the ink layer according to the present invention contains 50 to 80% (% by weight, hereinafter the same) of an ethylene-vinyl acetate copolymer having a vinyl acetate content of not more than 19%, 0 to 20%, preferably 10 to 20%, of a wax having a melting point of 70° to 90° C., 0 to 20%, preferably 10 to 20%, of a resin having a glass transition point of 50° to 140° C., and 20 to 50% of a coloring agent.

An ethylene-vinyl acetate copolymer of which the vinyl acetate content is not more than 19% usually has a softening point within the range of 70° to 100° C., which is higher than that of an ethylene-vinyl acetate copolymer of which the vinyl acetate content is more than 19%.

Accordingly, by incorporating 50 to 80% of such ethylene-vinyl acetate copolymer into the ink layer, it is possible to adjust the softening point of the vehicle in the ink layer to within the range of 60° to 85° C.

An ethylene-vinyl acetate copolymer of which the vinyl acetate content is too small has an excessively high softening point. Therefore, the vinyl acetate content is preferably not less than 10%.

However, it is difficult to obtain a vehicle having a melt viscosity at 100° C. of not lower than 1,000 poises and a melt viscosity at 160° C. of not higher than 400 poises by using an ethylene-vinyl acetate copolymer having a vinyl acetate content of not more than 19% alone.

From this point of view, in the present invention, the following ways are preferably adopted.

(1) The ink layer is incorporated with, as a heat-meltable material, 50 to 80% of one or more ethylene-vinyl acetate copolymers each having a vinyl acetate content of not more than 19 7% and not more than 20%, preferably 10 to 20%, of one or more waxes each having a melting point of 70° to 90° C.

In FIG. 1, an example of the melt viscosity curve of a wax having a melting point of 70° to 90° C. is shown as Curve D. By combination use of such a wax, it is made easy to adjust the softening point of the ink layer vehicle to within the range of 60° to 85° C. while maintaining the melt viscosity of the ink layer vehicle at 100° C. not lower than 1,000 poises and the melt viscosity of the ink layer vehicle at 160° C. not higher than 400 poises. When the content of the wax is less than 10%, the effect of the combination use is not always satisfactorily exhibited. When the content of the wax is more than 20%, the melt viscosity of the ink layer vehicle at 100° C. is prone to be lower than 1,000 poises.

(2) The ink layer is incorporated with, as a heat-meltable material, 50 to 80% of one or more ethylene-vinyl acetate copolymers each having a vinyl acetate content of not more than 19%, and not more than 20%, preferably 10 to 20%, of one or more resins each having a glass transition point 50° to 140° C.

By combination use of the resin having a glass transition point of 50° to 140° C., it is easy to adjust the melt viscosity of the ink layer vehicle at 100° C. to not lower than 1,000 poises and the melt viscosity of the ink layer vehicle at 160° C. to not higher than 400 poises with maintaining the softening point of the ink layer vehicle within the range of 60° to 85° C.

The use of a resin having a glass transition point of lower than 50° C. makes it difficult to adjust the melt viscosity of the ink layer vehicle at 100° C. to not lower than 1,000 poises. The use of a resin having a glass transition point of higher than 140° C. makes it difficult to adjust the melt viscosity of the ink layer vehicle at 160° C. to not higher than 400 poises. When the content of the resin having a glass transition point of 50° to 140° C. is less than 10%, the effect of the combination use is not always satisfactorily exhibited. When the content of the resin is more than 20%, the softening point of the vehicle is increased, resulting in a decrease in transfer sensitivity.

(3) The ink layer is incorporated with, as a heat-meltable material, 50 to 80% of one or more ethylene-vinyl acetate copolymers each having a vinyl acetate content of not more than 19%, not more than 20%, preferably 10 to 20%, of one or more waxes each having a melting point of 70° to 90° C., and not more than 20%, preferably 10 to 20%, of one or more resins each having a glass transition point of 50° to 140° C. When the wax having a melting point of 70° to 90° C. and the resin having a glass transition point of 50° to 140° C. are used in combination, it is particularly preferable that the content of a mixture of both components in the ink layer is from 10 to 20%.

By combination use of the wax and the resin, it is made easy to adjust the softening point of the ink layer vehicle to within the range of 60° to 85° C., the melt viscosity of the ink layer vehicle at 100° C. to not lower than 1,000 poises and the melt viscosity of the ink layer vehicle at 160° C. to not higher than 400 poises.

Examples of the aforesaid wax having a melting point of 70° to 90° C. include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes can be appropriately used.

Examples of the aforesaid resin having a glass transition point of 50° to 140° C. include rosins such as hydrogenated rosin, disproportionated rosin, polymerized rosin and rosin ester; rosin-modified resins such as rosin-modified phenol resin, rosin-modified maleic acid resin and rosin-modified xylene resin; terpene resins such as those obtained from polyterpene, aromatic compound-modified terpene, terpene-phenol, hydrogenated terpene or the like, and terpene-phenol-formaldehyde resin; petroleum resins such as resins obtained from $C_5$ aliphatic hydrocarbons, $C_5$ alicyclic hydrocarbons or derivatives thereof, and resins obtained from $C_9$ aromatic hydrocarbons, $C_9$ alicyclic hydrocarbons or derivatives thereof; homopolymer or copolymer resins of styrene or styrene derivatives such as α-methylstyrene; dicyclopentadiene resin, aromatic addition-condensation type petroleum resins and coumarone-indene resins; and further xylene resins, phenol resins, styrene-maleic anhydride resins resins and ketone resins. These can be appropriately used. In particular, resins having a melt viscosity at 160° C. of not poises, higher than 400 especially not higher than 200 poises are preferably used from the viewpoint of easy adjustment of the melt viscosity of the ink layer vehicle at 160° C. to not higher than 400 poises.

The coloring agent used in the ink layer can be any of conventional coloring agents for use in heat-meltable inks of this type, for example, verious inorganic or organic pigments and dyes, including carbon black.

The content of the coloring agent in the ink layer is usually within the range of from 20 to 50%.

The ink layer may be incorporated with an additive such as dispersing agent, antioxidant, antistatic agent or lubricating agent in addition to the aforesaid components so long as the object of the present invention is not injured.

The coating amount ( on a dry weight basis, hereinafter the same) of the ink layer is preferably from about 0.5 to 2.5 g/m$^2$.

When the ink layer is not readily released from the foundation when being transferred, it is preferable to interpose a release layer between the foundation and the ink layer.

Such a release layer is preferably a heat-meltable release layer containing a wax as a main component. Usable as the wax is any of waxes exemplified for the ink layer. As required, a small amount of a resin such as ethylene-vinyl acetate copolymer or ethylene-ethyl acrylate copolymer may be incorporated into the release layer for the purpose of regulating the adhesion between the release layer and the foundation or the ink layer.

The melting point of the release layer is preferably from about 60° to 100° C., and the coating amount of the release layer is preferably from about 0.5 to 1.5 g/m$^2$.

Usable as the foundation in the present invention are polyester films such as polyethylene terephthalate film, polyethylene naphthalate film and polyarylate film, polycarbonate films, polyamide films, aramid film and other various plastic films commonly used for the foundation of ink ribbons of this type. Thin paper sheets of high density such as condenser paper may also be used. The thickness of the foundation is preferably within the range of about 1 to 10 μm, particularly about 2 to 7 μm, for enhancing heat conduction.

When the aforesaid plastic film is used as the foundation, a stick-preventive layer may be formed on the back side ( the side adapted to come into slide contact with a thermal head) of the foundation. Examples of materials for the stick-preventive layer include various heat-resistant resins such as silicone resin, fluorine-containing resin, nitrocellulose resin, other resins modified with these heat-resistant resins including silicone-modified urethane resins and silicone-modified acrylic resins, and mixtures of the foregoing heat-resistant resins and lubricating agents.

BEST MODE FOR CARRYING OUT THE INVENTION

The present invention will be explained by way of Examples. In the following, the softening point and melt viscosity of vehicles and materials for vehicles were measured by use of a rheometer, MR-300 made by Rheology Co., Ltd.

EXAMPLES 1 to 3 AND COMPARATIVE EXAMPLES 1 to 3

A 3 μm-thick polyethylene terephthalate film was used wherein a 0.1 μm-thick silicone-modified urethane resin layer was formed on the back side thereof. The front side of the film was coated with a solution of microcrystalline wax in toluene, which was then dried to form a release layer having a melting point of 80° C. in a coating amount of 1.0 g/m$^2$.

Onto the thus formed release layer was-applied a coating liquid prepared by dissolving or dispersing each composition for an ink layer shown in Table 1 into toluene, followed by drying to form an ink in a layer coating amount of 2.0 g/m$^2$.

With use of each of the thus obtained thermal transfer recording media, printing was conducted on a rough paper sheet having a Bekk smoothness of 24 seconds by means of a thermal transfer printer (PCPR 150V made by NEC Corporation) at a printing energy of 18 mJ/mm$^2$ for evaluating the following properties. The results are shown in Table 3.

(1) Resistance to rubbing with eraser

The printed surface of the receptor paper was rubbed 20 times with a plastic eraser applied with a load of 200 g, and resistance to rubbing with eraser was evaluated according to the following ratings:

3 . . . no change

2 . . . legible despite being a little rubbed away

1 . . . illegible ( 2 ) Bridging transferability

A solid print image on the receptor paper was measured for its reflection optical density (OD value), and bridging transferability was evaluated according to the following ratings:

3 . . . OD value: 1.5 or greater

2 . . . OD value : 1.0 or greater and smaller than 1.5

1 . . . OD value :smaller than 1.0

(3 ) Scumming preventability

Printing was conducted under the same conditions as described above in an environment at 40° C., and stain produced on the receptor paper was observed. Scumming preventability was evaluated according to the following ratings:

3 . . . no scumming

2 . . . legible despite scumming

1 . . . illegible due to serious scumming

TABLE 1

| | Ex. 1 | Ex. 2 | Ex. 3 | Com. Ex. 1 | Com. Ex. 2 | Com. Ex. 3 |
|---|---|---|---|---|---|---|
| Ink formula (%) | | | | | | |
| EVA.I*[1] | 45 | 65 | 65 | — | — | — |
| EVA.II*[1] | 20 | — | — | — | 80 | — |
| EVA.III*[1] | — | — | — | 80 | — | 10 |
| Petroleum resin*[2] | 10 | 15 | — | — | — | — |
| Polyethylene wax (m.p. 80° C.) | 5 | — | 15 | — | — | 70 |
| Carbon black | 20 | 20 | 20 | 20 | 20 | 20 |
| Physical property of vehicle | | | | | | |
| Softening point | 70 | 70 | 75 | 45 | 88 | 78 |
| Viscosity at 100° C. (poise) | 2,000 | 2,500 | 3,000 | 6,000 | 200 | 50 |
| Viscosity at 160° C. (poise) | 300 | 350 | 290 | 1,200 | 20 | 30 |

*[1]Ethylene-vinyl acetate copolymers having vinyl acetate contents and physical properties shown in Table 2

*[2]glass transition point: 110° C., melt viscosity at 160° C.: 40 poises

TABLE 2

| | EVA.I | EVA.II | EVA.III |
|---|---|---|---|
| Vinyl acetate content (%) | 19 | 15 | 28 |
| Softening point (°C.) | 75 | 88 | 45 |
| Melt viscosity at 100° C. (poise) | 6,000 | 200 | 6,000 |
| Melt viscosity at 160° C. (poise) | 1,200 | 40 | 1,200 |

TABLE 3

| | Ex. 1 | Ex. 2 | Ex. 3 | Com. Ex. 1 | Com. Ex. 2 | Com. Ex. 3 |
|---|---|---|---|---|---|---|
| Resistance to rubbing with eraser | 3 | 3 | 3 | 1 | 2 | 3 |
| Bridging transferability | 3 | 3 | 3 | 3 | 2 | 1 |
| Scumming preventability | 3 | 3 | 3 | 1 | 3 | 3 |

As described above, the thermal transfer recording medium of the present invention is excellent in bridging transferability and fixability of print images and has a raised softening point, and, hence, assures clear print images on a rough paper sheet with a small amount of energy and keeps the receptor from scumming even in continuous printing.

I claim:

1. A thermal transfer recording medium comprising a foundation and a heat-meltable ink layer provided on the foundation, the ink layer containing 50 to 80% by weight of an ethylene-vinyl acetate copolymer having a vinyl acetate content of not more than 19% by weight, 0 to 20% by weight of a wax having a melting point of 70° C. to 90° C., 10 to 20% by weight of a resin having a glass transition point of 50° C. to 140° C., and 20 to 50% by weight of a coloring agent, the vehicle in the ink layer having a softening point of 60° C. to 85° C., a melt viscosity at 100° C. of not lower than 1,000 poises and a melt viscosity at 160° C. of not higher than 400 poises.

2. The thermal transfer recording medium of claim 1, wherein the vinyl acetate content of the ethylene-vinyl acetate copolymer is from 10 to 19% by weight.

3. The thermal transfer recording medium of claim 1, wherein a release layer is interposed between the foundation and the heat-meltable ink layer.

4. A thermal transfer recording medium comprising a foundation and a heat-meltable ink layer provided on the foundation, the ink layer containing 50 to 80% by weight of an ethylene-vinyl acetate copolymer having a vinyl acetate content of not more than 19% by weight, 10 to 20% by weight of a mixture of a wax having a melting point of 70° C. to 90° C. and a resin having a glass transition point of 50° C. to 140° C., and 20 to 50% by weight of a coloring agent, the vehicle in the ink layer having a softening point of 60° C. to 85° C., a melt viscosity at 100° C. of not lower than 1,000 poises and a melt viscosity at 160° C. of not higher than 400 poises.

5. The thermal transfer recording medium of claim 4 wherein the vinyl acetate content of the ethylene-vinyl acetate copolymer is from 10 to 19% by weight.

6. The thermal transfer recording medium of claim 4, wherein a release layer is interposed between the foundation and the heat-meltable ink layer.

* * * * *

UNITED STATES PATENT AND TRADEMARK OFFICE

CERTIFICATE OF CORRECTION

PATENT NO : 5,612,140

DATED : March 18, 1997

INVENTION(S) : THERMAL TRANSFER RECORDING MEDIUM

It is certified that error appears in the above-identified patent and that said Letters Patent is hereby corrected as shown below:

Column 3, line 26 delete "mount" and substitute therefor -- amount --.

Column 3, line 65 delete "19 7%" and substitute therefor -- 19% --.

Column 5, line 20 delete second occurrence of "resins".

Column 5, line 22 delete "poises, higher than 400" and substitute therefor -- higher than 400 poises, --.

Column 6, line 30 delete "was-applied" and substitute therefor -- was applied --.

Column 6, line 33 delete "in a layer" and substitute therefor -- layer in a --.

Signed and Sealed this

Third Day of October, 2000

*Attest:*

Q. TODD DICKINSON

*Attesting Officer*

*Director of Patents and Trademarks*